US011462367B2

(12) United States Patent
Chibahara

(10) Patent No.: US 11,462,367 B2
(45) Date of Patent: Oct. 4, 2022

(54) CONTACT MATERIAL, METHOD OF MANUFACTURING SAME, AND VACUUM VALVE

(71) Applicant: MITSUBISHI ELECTRIC CORPORATION, Chiyoda-ku (JP)

(72) Inventor: Hiroyuki Chibahara, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 503 days.

(21) Appl. No.: 16/477,410

(22) PCT Filed: Oct. 24, 2017

(86) PCT No.: PCT/JP2017/038357
§ 371 (c)(1),
(2) Date: Jul. 11, 2019

(87) PCT Pub. No.: WO2018/154848
PCT Pub. Date: Aug. 30, 2018

(65) Prior Publication Data

US 2019/0378664 A1 Dec. 12, 2019

(30) Foreign Application Priority Data

Feb. 22, 2017 (JP) ..... JP2017-030868

(51) Int. Cl.
*H01H 1/0233* (2006.01)
*C22C 9/00* (2006.01)
(Continued)

(52) U.S. Cl.
CPC ..... *H01H 1/0233* (2013.01); *B22F 3/16* (2013.01); *C22C 9/00* (2013.01); *C22C 19/03* (2013.01);
(Continued)

(58) Field of Classification Search
None
See application file for complete search history.

(56) References Cited

U.S. PATENT DOCUMENTS 5,420,384 A * 5/1995 Okutomi ..... H01H 1/0203 200/266

FOREIGN PATENT DOCUMENTS

CN 105593390 A 5/2016
JP 61-101919 A 5/1986
(Continued)

OTHER PUBLICATIONS

Machine translation of JP H 05-314869 A via Espacenet translated Jan. 19, 2022. (Year: 1993).*
(Continued)

*Primary Examiner* — Elizabeth Collister
(74) *Attorney, Agent, or Firm* — Oblon, McClelland, Maier & Neustadt, L.L.P.

(57) ABSTRACT

Provided is a method of manufacturing a contact material, including the steps of: forming a Ni alloy film having a film thickness of 40 nm or more and 110 nm or less on a surface of WC powder having an average particle diameter of 2 μm or more and 10 μm or less by an electroless Ni plating method; performing heat treatment for degassing at a temperature of 500° C. or more and 860° C. or less; crushing Ni alloy-coated WC powder after the heat treatment; mixing the crushed Ni alloy-coated WC powder and Cu powder having an average particle diameter of 1 μm or more and 100 μm or less; and compressing the resultant mixture, followed by sintering the mixture at a temperature of more than 1,083° C. and less than 1,455° C.

18 Claims, 7 Drawing Sheets

(51) Int. Cl.

| | |
|---|---|
| ***C22C 19/03*** | (2006.01) |
| ***C22C 29/08*** | (2006.01) |
| ***H01H 1/025*** | (2006.01) |
| ***B22F 3/16*** | (2006.01) |

(52) U.S. Cl.
CPC ..... *C22C 29/08* (2013.01); *H01H 1/025* (2013.01); *B22F 2301/10* (2013.01); *B22F 2301/15* (2013.01)

(56) References Cited

FOREIGN PATENT DOCUMENTS

| | | | |
|---|---|---|---|
| JP | 62-264514 | A | 11/1987 |
| JP | 5-311273 | A | 11/1993 |
| JP | 5-314869 | A | 11/1993 |
| JP | 06103858 | A * | 4/1994 |
| JP | 7-320608 | A | 12/1995 |
| JP | 2004-71436 | A | 3/2004 |
| JP | 2009-87746 | A | 4/2009 |
| JP | 2012-248521 | A | 12/2012 |

OTHER PUBLICATIONS

K. Zangeneh-Madar, M. Amirjan, N. Parvin, Improvement of physical properties of Cu-infiltrated W compacts via electroless nickel plating of primary tungsten powder, Surface and Coatings Technology, vol. 203, Issue 16, pp. 2333-2336 (Year: 2009).*

Machine translation of JP H06-103858 A translated via Espacenet on Mar. 7, 2022 (Year: 1994).*

International Search Report dated Jan. 16, 2018 in PCT/JP2017/038357 filed on Oct. 24, 2017.

Combined Chinese Office Action and Search Report dated Jun. 1, 2021 in corresponding Chinese Patent Application No. 201780086386.4 (with English Translation and English Translation of Category of Cited Documents), 13 pages.

* cited by examiner

CONTACT MATERIAL, METHOD OF MANUFACTURING SAME, AND VACUUM VALVE

TECHNICAL FIELD

The present invention relates to a contact material, a method of manufacturing the same, and a vacuum valve.

BACKGROUND ART

In high-voltage distribution facilities, and the like, vacuum circuit breakers are used for interrupting a current in the event of a fault or at an abnormal time. Along with an increase in capacity, an increase in pressure resistance, and a reduction in size of the vacuum circuit breaker, an improvement in performance of a vacuum valve installed in the vacuum circuit breaker has been required. The vacuum valve has a structure in which a fixed electrode and a movable electrode are coaxially arranged so as to oppose to each other in an insulation container maintained under high vacuum. When an overload current or a short circuit current is generated in the distribution facilities, such current can be interrupted by instantly opening those electrodes.

A contact material to be used in a contact portion between the fixed electrode and the movable electrode of such vacuum valve is mainly required to exhibit breaking performance, voltage resistance performance, and welding resistance performance. In addition, those performances required for the contact material are properties contradicting each other, and hence it is difficult to manufacture the contact material by using a material formed of a single element. In this connection, the contact material has hitherto been manufactured by using a material formed of a combination of two or more kinds of elements. For example, there is generally used a contact material using Cu as a highly conductive material and using W or Cr as an arc resistant material having a highly suppressing effect on the dissolution of a contact caused by an arc at the time of opening the electrodes.

When an alternating current is interrupted, the alternating current is ideally interrupted at a time point when a current value is zero. However, in actuality, a phenomenon called chopping in which the current is instantly interrupted before that time point occurs. Depending on a capacitive load or an inductive load connected the distribution facilities, a large back electromotive force called a switching surge is generated at the time of chopping, and a device is damaged in some cases. In view of the foregoing, there is proposed a contact material obtained by combining Ag or Cu serving as a highly conductive material with tungsten carbide (WC) having a lower work function than Ag or Cu and emitting electrons more easily. With this, a chopping current is reduced and a low surge property is achieved.

For example, in Patent Document 1, there is disclosed a technology for improving the breaking characteristics and reignition characteristics of a contact material for a vacuum circuit breaker by optimizing various metallurgical conditions of a Cu—WC alloy. In Patent Document 1, there is also described that, when 1% or less of an auxiliary component including at least one of Co, Ni, or Fe is incorporated therein, the density of a sintered compact can be widely controlled to provide a sound sintered compact, and more stable reignition characteristics and breaking characteristics are obtained. In addition, in Patent Document 2, there is disclosed a contact material for a vacuum valve including: 19 wt % to 50 wt % of a highly conductive component including at least one of Ag or Cu; 49 wt % to 80 wt % of an arc resistant component; and 1 wt % or less of an auxiliary arc resistant component including at least one of Fe, Ni, or Co, in which Ag or Cu of the highly conductive component is infiltrated into a skeleton formed by using a product obtained by coating a periphery of the arc resistant component with the auxiliary arc resistant component. In Patent Document 2, there is described that, when a contact is manufactured from such contact material for a vacuum valve, a vacuum valve maintaining a low chopping current value and having less fluctuation in chopping current value can be obtained.

CITATION LIST

Patent Document

Patent Document 1: Japanese Patent Application Laid-open No. 2004-71436

Patent Document 2: Japanese Patent Application Laid-open No. H5-314869

SUMMARY OF INVENTION

Technical Problem

However, the contact materials of Patent Documents 1 and 2 have insufficient strength, and hence there arises a problem in that cracks occur due to a mechanical impact at the time of contact switching or due to a thermal impact due to an energized arc, which results in an increase in chopping current.

The present invention has been made to solve the above-mentioned problem, and an object of the present invention is to provide a contact material having high strength and capable of maintaining a low chopping current.

Solution to Problem

According to one embodiment of the present invention, there is provided a contact material having a structure in which WC particles each coated with a Ni alloy are dispersed in a matrix formed mainly of Cu, wherein a content of the Ni alloy with respect to the contact material falls within a range of 1.2 mass % or more and 3.7 mass % or less, and wherein a relative density of the contact material is 90% or more of a theoretical density of the contact material.

Advantageous Effects of Invention

According to the present invention, the contact material having high strength and capable of maintaining a low chopping current can be provided.

DESCRIPTION OF EMBODIMENTS

First Embodiment

Figure 1:
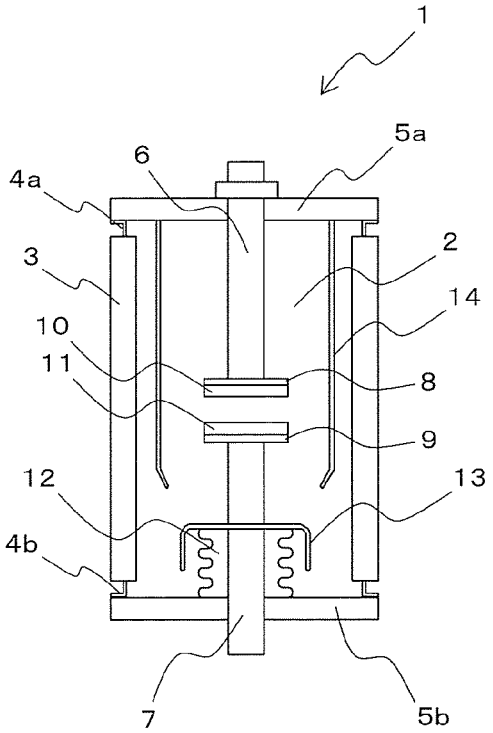
FIG. 1 is a schematic sectional view for illustrating an example of a vacuum valve to which a contact material according to a first embodiment is applied.

FIG. 1 is a schematic sectional view for illustrating an example of a vacuum valve to which a contact material according to a first embodiment of the present invention is applied. A vacuum valve 1 includes a breaking chamber 2. The breaking chamber 2 includes: an insulation container 3 formed into a cylindrical shape; and metal covers 5*a* and 5*b* fixed to both ends of the insulation container 3 with sealing fittings 4*a* and 4*b*, and is rendered vacuum tight. A fixed electrode rod 6 and a movable electrode rod 7 are installed in the breaking chamber 2 so as to oppose to each other. A fixed electrode 8 and a movable electrode 9 are mounted to end portions of the fixed electrode rod 6 and the movable electrode rod 7, respectively, through brazing, and a fixed contact 10 and a movable contact 11 are mounted to contact portions of the fixed electrode 8 and the movable electrode 9, respectively, through brazing. A bellows 12 is mounted to the movable electrode rod 7, to thereby enable movement of the movable electrode 9 in an axial direction while retaining the inside of the breaking chamber 2 vacuum tight. An arc shield 13 for bellows made of a metal is arranged in an upper portion of the bellows 12, to thereby prevent adhesion of an arc vapor to the bellows 12. In addition, an arc shield 14 for an insulation container made of a metal is arranged in the breaking chamber 2 so as to cover the fixed electrode 8 and the movable electrode 9, to thereby prevent exposure of an inner wall of the insulation container 3 to the arc vapor.

Figure 2:
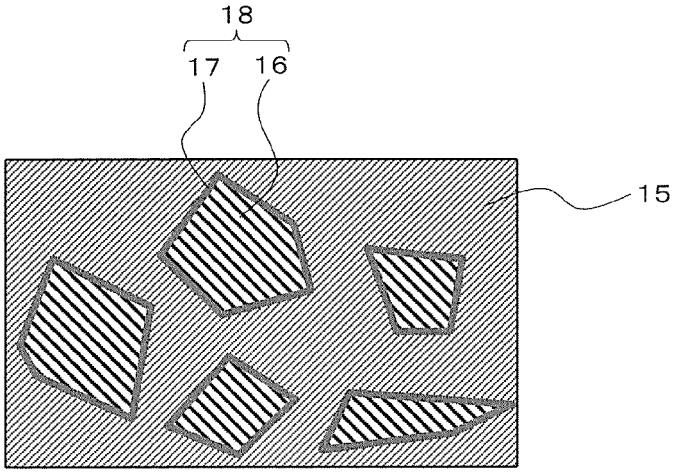
FIG. 2 is a schematic sectional view for illustrating an internal structure of the contact material according to the first embodiment.

The contact material according to this embodiment is used for the fixed contact 10 and the movable contact 11 mounted to the fixed electrode 8 and the movable electrode 9, respectively. The contact material according to this embodiment has a structure in which WC particles each coated with a Ni alloy are dispersed in a matrix formed mainly of Cu. FIG. 2 is a schematic sectional view for illustrating an internal structure of the contact material according to this embodiment. As illustrated in FIG. 2, WC particles 18 obtained by coating peripheries of WC particles 16 with a Ni alloy 17 are dispersed in a matrix 15 formed mainly of Cu. The wettability between WC and the Ni alloy and the wettability between the Ni alloy and Cu are satisfactory, and hence the adhesiveness between the WC particles 18 each coated with the Ni alloy 17 and the matrix 15 is high. In the contact material according to this embodiment, the Ni alloy is contained at a content falling within a range of 1.2 mass % or more and 3.7 mass % or less, and hence the surfaces of the WC particles 16 are not exposed and are uniformly coated with the Ni alloy 17. Therefore, the contact material according to this embodiment has significantly high strength, and millimeter-order cracks are less liable to occur due to a mechanical impact at the time of contact switching or due to a thermal impact due to an energized arc. Further, the relative density of the contact material according to this embodiment is 90% or more, preferably 93% or more of the theoretical density of the contact material. When the relative density is 90% or more of the theoretical density, the amount of a gas remaining inside is sufficiently small. Thus, even when the contact material is applied to a vacuum valve, the vacuum valve has no fluctuation in breaking performance. The relative density is determined by the following equation.

Relative density (%)=(measured density of the contact material/theoretical density of the contact material determined from a composition analysis value)×100

In addition, the contact material according to this embodiment may contain slight amounts of unavoidable impurities (e.g., Ag, Al, Fe, Si, P, O, N, and H) contained in raw materials.

Figure 3:
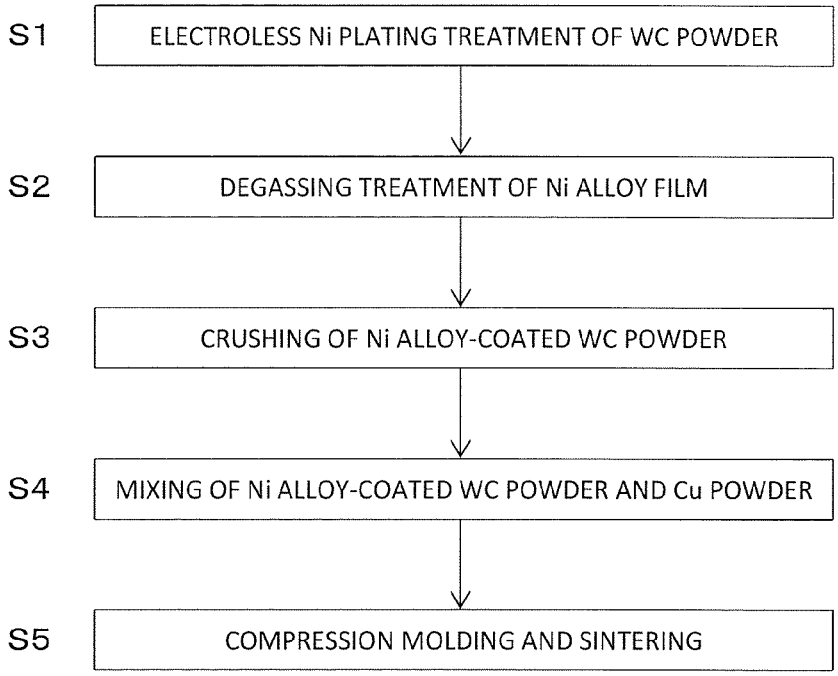
FIG. 3 is a flowchart of production steps for the contact material according to the first embodiment.

The contact material having such internal structure and relative density is manufactured through the following steps: a step of forming a Ni alloy film having a predetermined film thickness on a surface of WC powder having a predetermined average particle diameter by an electroless Ni plating method; a step of retaining the resultant Ni alloy-coated WC powder at a temperature equal to or lower than the melting point of the Ni alloy under vacuum or under a non-oxidizing atmosphere to remove impurities in the Ni alloy film (degassing treatment of the Ni alloy film); a step of crushing the Ni alloy-coated WC powder having been lightly sintered; a step of mixing the crushed Ni alloy-coated WC powder and Cu powder having a predetermined average particle diameter; and a step of compressing the resultant mixture, followed by sintering the mixture at a temperature of more than 1,083° C. and less than 1,455° C. FIG. 3 is a flowchart of those production steps.

Figure 4:
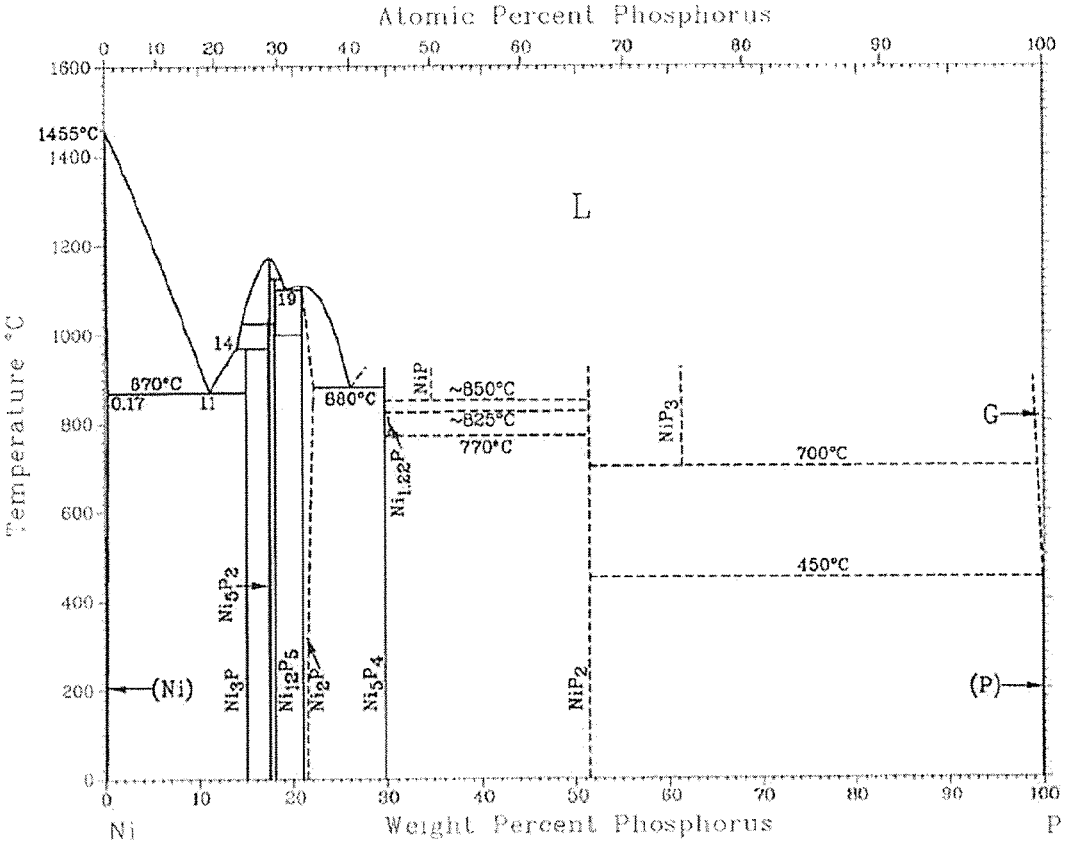
FIG. 4 is a phase diagram of a Ni—P alloy system.

As illustrated in FIG. 3, when the contact material according to this embodiment is manufactured, first, a Ni alloy film is formed on the surface of WC powder by an electroless Ni plating method (Step S1). As an electroless Ni plating liquid to be used herein, any known electroless Ni plating liquid, such as a Ni—P plating liquid or a Ni—P—B plating liquid, may be used. Of those, a Ni—P plating liquid is preferably used because of being inexpensive, having high coating properties, and being non-magnetic. The Ni—P plating liquid is an alkaline solution having a pH of from about 8 to about 9.5 containing, as main components, a nickel salt, such as nickel sulfate or nickel chloride, a reducing agent, such as sodium hypophosphite, and a complexing agent, such as lactic acid or succinic acid. A bath temperature is not particularly limited, but is generally from about 30° C. to about 50° C. In addition, the Ni alloy film formed through use of the Ni—P plating liquid contains P (phosphorus) at a content falling within a range of from about 3 mass % to about 10 mass %. From FIG. 4, it is found that a Ni—P alloy has a melting point of 870° C., which is much lower than the melting point of elemental Ni, 1,455° C. Therefore, the use of the Ni—P plating liquid is preferred because a low sintering temperature can be set during the manufacture of the contact material. In addition, it is appropriate, before electroless Ni plating, to immerse the WC powder in a palladium chloride solution to cause Pd (palladium) ions to be adsorbed onto the surface of the WC powder, to thereby activate the surface.

As the WC powder serving as a raw material, WC powder having an average particle diameter of 2 μm or more and 10 μm or less, preferably 3 μm or more and 9 μm or less is used. The case in which the WC powder has an average particle diameter of less than 2 μm is not preferred because the content of the Ni alloy is excessively increased. Meanwhile, the case in which the WC powder has an average particle diameter of more than 10 μm is not preferred because the mechanical strength of a contact is reduced. In addition, the film thickness of the Ni alloy film to be formed on the surface of the WC powder is 40 nm or more and 110 nm or less, preferably 50 nm or more and 100 nm or less. The case in which the film thickness of the Ni alloy film is less than 40 nm is not preferred because it becomes difficult to form a uniform film, and an island-shaped film is formed. Meanwhile, the case in which the film thickness of the Ni alloy film is more than 110 nm is not preferred because the Ni alloy film formed by the electroless Ni plating method becomes nonuniform, and the WC powder is liable to be coarsened due to progress in aggregation.

Next, in order to remove impurities contained in the Ni alloy film of the Ni alloy-coated WC powder obtained through Step S1, the Ni alloy-coated WC powder is subjected to heat treatment at 500° C. or more and 860° C. or less in a vacuum furnace or a non-oxidizing atmosphere furnace (e.g., Ar or $H_2$) (Step S2).

The Ni alloy-coated WC powder is lightly sintered through the heat treatment of Step S2. Therefore, before mixed with Cu powder, the Ni alloy-coated WC powder is crushed with, for example, a stirring mortar machine (Step S3).

After that, the Ni alloy-coated WC powder obtained through Step S3 and Cu powder are mixed with each other (Step S4). As a mixing method to be used herein, any method may be used as long as a homogeneous mixture is obtained. An example thereof is a known method involving using a stirrer, a mixer, or the like. As the Cu powder serving as a raw material, Cu powder having an average particle diameter of 1 μm or more and 100 μm or less, preferably 30 μm or more and 50 μm or less is used. The case in which the Cu powder has an average particle diameter of less than 1 μm is not preferred because a reduction in density occurs at the time of compression. Meanwhile, the case in which the Cu powder has an average particle diameter of more than 100 μm is not preferred because the mixing is liable to be uneven due to a difference in material specific gravity.

Subsequently, a powder mixture obtained through Step S4 is compressed, followed by being sintered at a predetermined temperature (Step S5). Herein, the compression is performed as follows: the powder mixture is filled in a press mold formed of a high-strength iron and steel material, such as die steel or high-speed steel, and is then compressed at a molding pressure of 300 MPa or more and 1,000 MPa or less. When the molding pressure falls within the above-mentioned range, a gas remaining inside can be reduced to increase the density of a molded body. The sintering of the molded body is performed as follows: the molded body is heated at a temperature of more than 1,083° C. and less than 1,455° C. under vacuum or a reducing atmosphere of hydrogen. When a sintering temperature falls within the above-mentioned range, the adhesiveness between WC and the Ni alloy and the adhesiveness between the Ni alloy and Cu can be increased while Cu is dissolved. When the relative density of the resultant sintered compact is less than 90% of the theoretical density of the sintered compact, it is appropriate to recompress the sintered compact at a molding pressure of 300 MPa or more and 1,000 MPa or less, followed by resintering the sintered compact at a temperature of more than 1,083° C. and less than 1,455° C. In each sintering, a sintering time period may be set to a time period enough for the WC particles each coated with the Ni alloy to be dispersed in the matrix formed mainly of Cu, and is generally 1 hour or more and 8 hours or less.

The contact material thus obtained is mechanically processed as required so as to serve as a contact for a vacuum valve. Specifically, the contact material is ground until a design thickness and a design diameter required for the contact for a vacuum valve are achieved, tapered on its edge portion, or polished on its surface.

EXAMPLES

The present invention is described in more detail below by way of Examples and Comparative Examples.

Example 1

Figure 5:
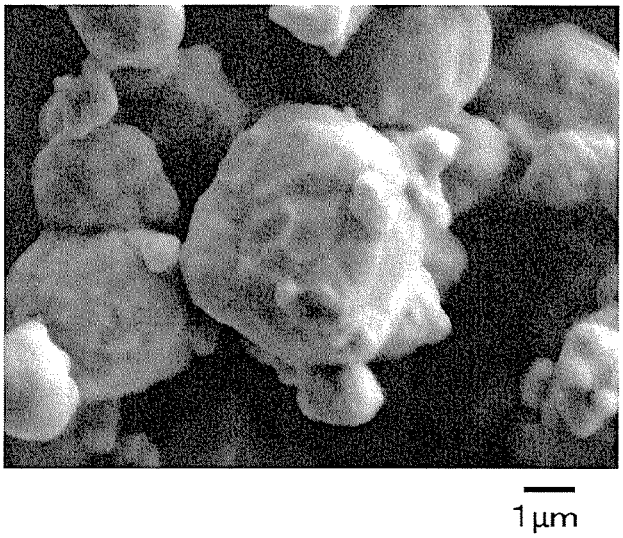
FIG. 5 is a SEM image of WC powder after electroless Ni plating treatment in Example 1.
Figure 6:
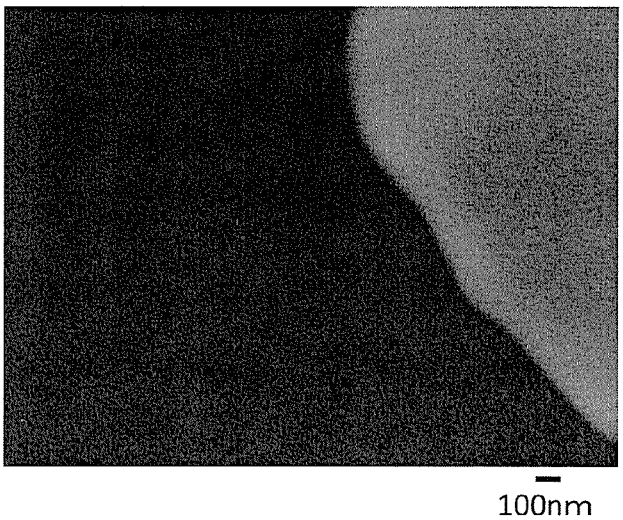
FIG. 6 is a SEM image of a cross section of the WC powder after the electroless Ni plating treatment in Example 1.
Figure 7:
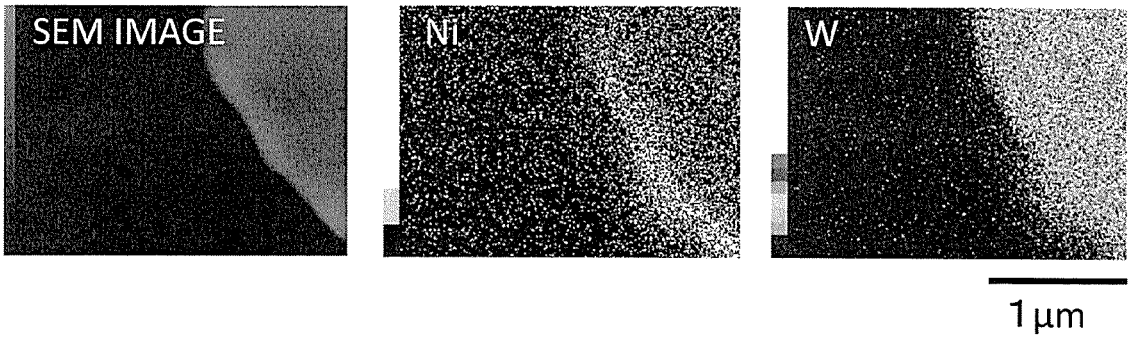
FIG. 7 includes element mapping images of the cross section of the WC powder after the electroless Ni plating treatment in Example 1.

WC powder having an average particle diameter of 3 μm was subjected to electroless Ni plating treatment using an electroless Ni—P plating liquid. A target plating film thickness was set to nm. After the electroless Ni plating treatment, the P concentration in a Ni alloy film was measured to be 3.1 mass % by ICP emission spectroscopy. FIG. 5 is a scanning electron microscope (SEM) image of the WC powder after the electroless Ni plating treatment. FIG. 6 is a scanning electron microscope (SEM) image of a cross section of the WC powder after the electroless Ni plating treatment. In addition, FIG. 7 includes element mapping images of a portion shown in FIG. 6. From FIG. 7, it is revealed that Ni is present at a periphery of the WC powder. From FIG. 6, it is revealed that the Ni alloy film is uniformly formed with such a small film thickness as not to be recognized distinctly.

Next, the resultant Ni alloy-coated WC powder was loaded in a container made of alumina, and was subjected to heat treatment in a vacuum furnace set to a degree of vacuum of from $1\times10^{-4}$ Pa to $2\times10^{-4}$ Pa and a furnace temperature of 650° C. for 2 hours, followed by cooling. Then, the container made of alumina was taken out of the furnace.

The Ni alloy-coated WC powder having been lightly sintered was taken out of the container made of alumina, loaded in a stirring mortar machine, and crushed for 10 minutes.

After the crushing, 67.6 mass % of the Ni alloy-coated WC powder (WC: 63.9 mass %, Ni alloy: 3.7 mass %) and 32.4 mass % of Cu powder having an average particle diameter of 15 μm were mixed with a stirrer for 4 hours.

The resultant powder mixture was loaded in a circular mold having a diameter of 25 mm made of die steel, and was compression-molded at a pressure of 720 MPa with a hydraulic press machine. A target thickness was set to 5 mm. The relative density of the resultant molded body was calculated based on the dimensions of the molded body. As a result, the relative density of the molded body was found to be about 83% of the theoretical density of the molded body. Subsequently, the molded body was sintered in a hydrogen furnace at 1,100° C. for 5 hours. The relative density of the resultant sintered compact was 88% of the theoretical density of the sintered compact. The sintered compact was recompressed at a pressure of 720 MPa though use of the same mold, and as a result, the relative density reached 93%. Further, the sintered compact was resintered in a hydrogen furnace at 1,100° C. for 5 hours. Thus, a contact material of Example 1 having a relative density of 96.0% was obtained.

Example 2

Ni alloy-coated WC powder was prepared in the same manner as in Example 1 except that WC powder having an average particle diameter of 5 μm was used. Next, 66.1 mass % of the Ni alloy-coated WC powder (WC: 63.9 mass %, Ni alloy: 2.2 mass %) and 33.9 mass % of Cu powder having an average particle diameter of 15 μm were mixed with a stirrer for 4 hours. The resultant powder mixture was compressed and sintered in the same manner as in Example 1. Thus, a contact material of Example 2 having a relative density of 97.1% was obtained.

Example 3

Ni alloy-coated WC powder was prepared in the same manner as in Example 1 except that WC powder having an average particle diameter of 9 μm was used. Next, 65.1 mass % of the Ni alloy-coated WC powder (WC: 63.9 mass %, Ni alloy: 1.2 mass %) and 34.9 mass % of Cu powder having an average particle diameter of 15 μm were mixed with a stirrer for 4 hours. The resultant powder mixture was compressed and sintered in the same manner as in Example 1. Thus, a contact material of Example 3 having a relative density of 97.6% was obtained.

Comparative Example 1

A contact material of Comparative Example 1 (WC: 63.9 mass %, Cu: 36.1 mass %) having a relative density of 95% was obtained in the same manner as in Example 1 except that electroless Ni plating treatment was not performed.

Comparative Example 2

Ni alloy-coated WC powder was prepared in the same manner as in Example 1 except that the target plating film thickness was changed to 0.1 μm. Next, 71.6 mass % of the Ni alloy-coated WC powder (WC: 63.9 mass %, Ni alloy: 7.7 mass %) and 28.4 mass % of Cu powder having an average particle diameter of 15 μm were mixed with a stirrer for 4 hours. The resultant powder mixture was compressed and sintered in the same manner as in Example 1. Thus, a contact material of Comparative Example 2 having a relative density of 96.2% was obtained.

Comparative Example 3

Ni alloy-coated WC powder was prepared in the same manner as in Example 1 except that the target plating film thickness was changed to 10 nm. Next, 65 mass % of the Ni alloy-coated WC powder (WC: 64 mass %, Ni alloy: 1 mass %) and 35 mass % of Cu powder having an average particle diameter of 15 μm were mixed with a stirrer for 4 hours. The resultant powder mixture was compressed and sintered in the same manner as in Example 1. Thus, a contact material of Comparative Example 3 having a relative density of 95.3% was obtained.

Evaluation of Mechanical Strength

Figure 8A:
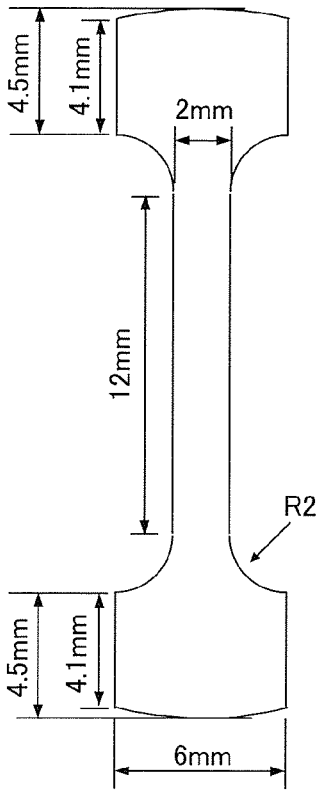
FIG. 8A is a front view of a test piece used for a tensile strength test.
Figure 8B:
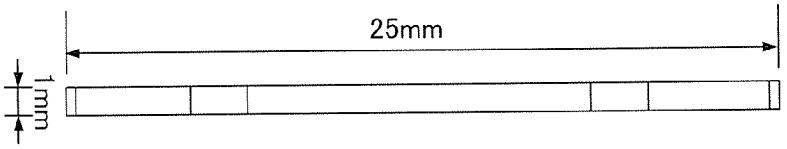
FIG. 8B is a side view of the test piece.

The contact materials obtained in Examples and Comparative Examples were each processed to manufacture a test piece for a tensile strength test having a shape illustrated in FIG. 8. As illustrated in FIG. 8, a central portion thereof, to which a tensile stress was applied, had a shape measuring 2 mm in width, 12 mm in length, and 1 mm in thickness. The central portion having a length of 12 mm was processed to R2 mm on both ends, and the test piece had a width of 6 mm on both ends so as to withstand a shear stress. In addition, the test piece was subjected to mirror finish processing so that a burr or the like was removed. A tensile test was performed as follows: the R2 portions of the test piece illustrated in FIG. 8 were each sandwiched between two round rods each having a diameter of 4 mm, and a tensile stress in a vertical direction was applied to the test piece through the round rods. A tensile stress at a time when the test piece broke was defined as breaking strength. The tensile test was performed twice (n=2) for each test piece. The results are shown in Table 1.

Evaluation of Breaking Characteristics

The contact materials obtained in Examples and Comparative Examples were each mechanically processed to manufacture a contact measuring 20 mm in diameter and 3 mm in thickness. The surface of the contact was tapered by about 15° in a portion within 2 mm from an edge portion, and hence a substantial contact surface of the contact had a diameter of 16 mm. A vacuum valve was assembled by using two such contacts as a movable contact and a fixed contact after the contacts were brazed to conductors. The breaking characteristics of the vacuum valve were evaluated through a chopping current test, an ultimate breaking current test, and a chopping current test after a breaking test.

The chopping current test was performed as described below. A circuit was formed by using an AC source of 200 V and serially connecting a resistance of 20Ω and the vacuum valve for evaluation. A chopping current was measured at a time when the valve was opened from a state in which a current of 10 A was applied. The breaking test was performed as described below. An applied current value was controlled through utilization of discharge from a charged capacitor bank. The breaking test was performed by increasing a breaking current in increments of 1 kA from 2 kA, and a breaking current value previous to a current value at which breaking failed was defined as an ultimate breaking current. The chopping current test was performed 20 times, and the average value thereof was taken. The results are shown in Table 1.

TABLE 1

| | Breaking strength [MPa] | Chopping current [A] | Ultimate breaking current [kA] | Chopping current after breaking test [A] |
|---|---|---|---|---|
| Example 1 | 352, 341 | 0.92 | 5.0 | 0.97 |
| Example 2 | 334, 349 | 0.91 | 5.0 | 0.95 |
| Example 3 | 325, 321 | 0.91 | 5.0 | 0.93 |
| Comparative Example 1 | 251, 263 | 0.90 | 5.0 | 1.20 |
| Comparative Example 2 | 344, 362 | 1.02 | 3.0 | 1.10 |
| Comparative Example 3 | 262, 271 | 0.91 | 5.0 | 1.22 |

From Table 1, it is revealed that the contact material of Example 1 has sufficiently high mechanical strengths of 352 MPa and 341 MPa. In addition, the contact material of Example 1 had a chopping current of 0.92 A before the breaking test, and had a chopping current of 0.97 A even after the breaking test. The rate of increase in chopping current value before and after the breaking test was about 5%. Further, the contact material of Example 1 had an ultimate breaking current of 5.0 kA. The vacuum valve was disassembled after the test and the contact was examined. As a result, a welding mark due to an arc was observed, but such cracks as to cause escaping of the contact were not observed.

It is revealed that the contact material of Example 2 has sufficiently high mechanical strengths of 334 MPa and 349 MPa, which are slightly lower than in Example 1. In addition, the contact material of Example 2 had a chopping current of 0.91 A before the breaking test, and had a chopping current of 0.95 A even after the breaking test. The rate of increase in chopping current value before and after the breaking test was about 4%. Further, the contact material of Example 2 had an ultimate breaking current of 5.0 kA. Such cracks as to cause escaping of the contact were not observed also in the contact material of Example 2.

It is revealed that the contact material of Example 3 has sufficiently high mechanical strengths of 325 MPa and 321 MPa, which are slightly lower than in Example 2. In addition, the contact material of Example 3 had a chopping current of 0.91 A before the breaking test, and had a chopping current of 0.93 A even after the breaking test. The rate of increase in chopping current value before and after the breaking test was about 2%. Further, the contact material of Example 3 had an ultimate breaking current of 5.0 kA. Such cracks as to cause escaping of the contact were not observed also in the contact material of Example 3.

The contact material of Comparative Example 1 had breaking strengths of 251 MPa and 263 MPa, which were lower than in Examples 1 to 3. In addition, while the contact material of Comparative Example 1 had a chopping current of 0.9 A before the breaking test, the contact material had a chopping current of 1.2 A after the breaking test. The rate of increase in chopping current value before and after the breaking test was about 33%. The contact material of Comparative Example 1 had an ultimate breaking current of 5 kA. The vacuum valve was disassembled after the test and the contact was examined. As a result, cracks occurred on a surface, and part of the contact escaped. It is considered that the part of the contact was broken due to a mechanical impact at the time of contact switching and due to a thermal impact due to an arc at the time of energization in the breaking test because the adhesiveness between Cu and WC was low.

The contact material of Comparative Example 2 had breaking strengths of 344 MPa and 362 MPa, which were at the same level as those in Examples 1 to 3. In addition, while the contact material of Comparative Example 2 had a chopping current of 1.02 A before the breaking test, the contact material had a chopping current of 1.10 A after the breaking test. The rate of increase in chopping current value before and after the breaking test was about 8%. In addition, the contact material of Comparative Example 2 had an ultimate breaking current of 3 kA, which was lower than in Examples 1 to 3.

The contact material of Comparative Example 3 had breaking strengths of 262 MPa and 271 MPa, which were lower than in Examples 1 to 3. In addition, while the contact material of Comparative Example 3 had a chopping current of 0.91 A before the breaking test, the contact material had a chopping current of 1.22 A after the breaking test. The rate of increase in chopping current value before and after the breaking test was about 34%. The contact material of Comparative Example 3 had an ultimate breaking current of 5 kA. The vacuum valve was disassembled after the test and the contact was examined. As a result, as in Comparative Example 1, cracks occurred on a surface, and part of the contact escaped. It is considered that the part of the contact was broken due to a mechanical impact at the time of contact switching and due to a thermal impact due to an arc at the time of energization in the breaking test because an increase in mechanical strength was insufficient.

Figure 9:
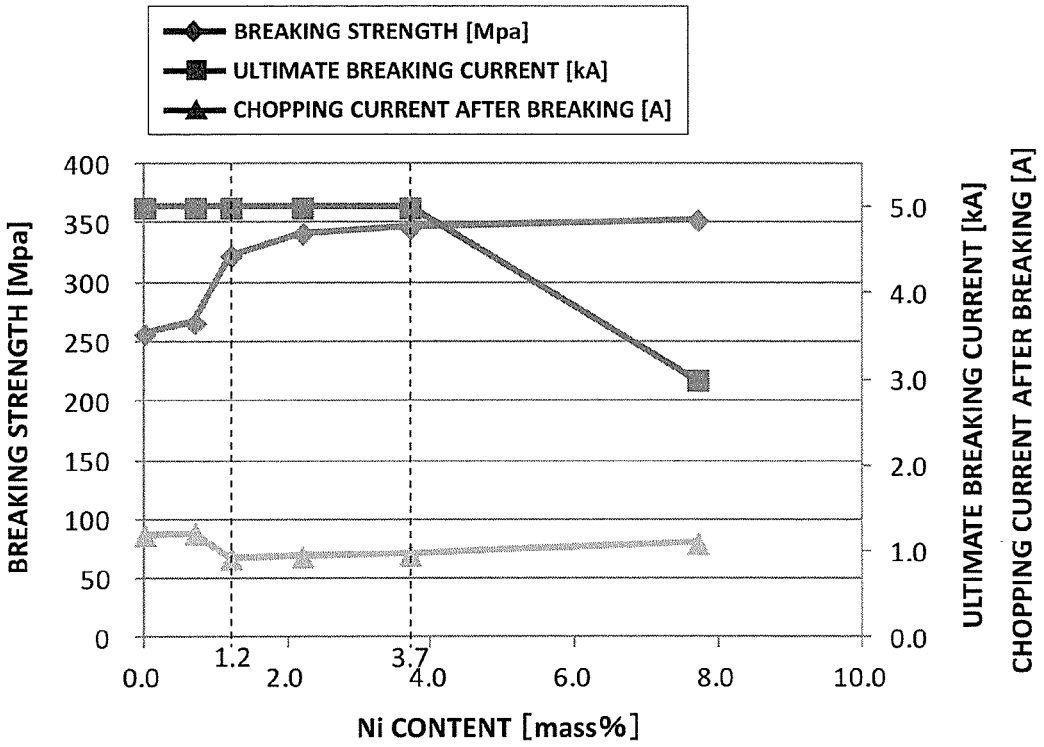
FIG. 9 is a graph for showing a relationship between test results (breaking strength, an ultimate breaking current, and a chopping current after breaking) and a Ni content in Examples 1 to 3 and Comparative Examples 1 to 3.

The relationship between the test results (the breaking strength (average value in the test performed twice), the ultimate breaking current, and the chopping current after the breaking test) and the Ni content in Examples 1 to 3 and Comparative Examples 1 to 3 was summarized in a graph shown in FIG. 9. It is revealed that, when the Ni content falls within a range of from 1.2 mass % to 3.7 mass %, the mechanical strength is high, the ultimate breaking current and the chopping current are also stable, and the above-mentioned three items fall within optimal ranges. As described above, it was able to be confirmed that, with the contact materials of Examples 1 to 3, in each of which the Ni alloy film was formed into an appropriate thickness and the Ni alloy content fell within a predetermined range, the mechanical strength (adhesiveness) of the contact itself was increased to prevent escaping of the contact, and stable breaking characteristics were exhibited.

The present international application claims priority based on Japanese Patent Application No. 2017-030868 filed on Feb. 22, 2017, the contents of which are incorporated herein by reference in their entirety.

EXPLANATION ON NUMERALS

1 vacuum valve
2 breaking chamber
3 insulation container
4*a*, 4*b* sealing fitting
5*a*, 5*b* metal cover
6 fixed electrode rod
7 movable electrode rod
8 fixed electrode
9 movable electrode
10 fixed contact
11 movable contact
12 bellows
13 arc shield for bellows
14 arc shield for insulation container
15 Cu matrix
16 WC particle
17 Ni alloy
18 WC particle coated with Ni alloy

The invention claimed is:

1. A contact material, comprising:
a matrix comprising Cu; and
a WC powder coated with a Ni alloy and dispersed in the matrix,
wherein a content of the Ni alloy with respect to the contact material is in a range of 1.2 mass % to 3.7 mass %, and a relative density of the contact material is 90% or more of a theoretical density of the contact material.

2. The contact material according to claim 1, wherein the Ni alloy is a Ni—P alloy.

3. The contact material according to claim 1, wherein the content of the Ni alloy with respect to the contact material is in a range of 1.2 mass % to 3.7 mass % such that a balance is Cu, WC and unavoidable impurities.

4. The contact material according to claim 2, wherein the content of the Ni alloy with respect to the contact material is in a range of 1.2 mass % to 3.7 mass % such that a balance is Cu, WC and unavoidable impurities.

5. A vacuum valve, comprising:
a contact formed of the contact material of claim 1.

6. A vacuum circuit breaker, comprising:
a contact formed of the contact material of claim 1.

7. The contact material according to claim 1, wherein the matrix is formed of Cu.

8. The contact material according to claim 1, wherein the Ni alloy is a Ni—P—B alloy.

9. The contact material according to claim 1, wherein the WC powder has an average particle diameter in a range of 2 μm to 10 gm.

10. The contact material according to claim 1, wherein the Ni alloy has a film thickness in a range of 40 nm to 110 nm.

11. The contact material according to claim 1, wherein the relative density of the contact material is 93% or more of a theoretical density of the contact material.

12. The contact material according to claim 2, wherein the matrix is formed of Cu.

13. The contact material according to claim 2, wherein the WC powder has an average particle diameter in a range of 2 μm to 10 gm.

14. The contact material according to claim 2, wherein the Ni alloy has a film thickness in a range of 40 nm to 110 nm.

15. The contact material according to claim 2, wherein the relative density of the contact material is 93% or more of a theoretical density of the contact material.

16. The contact material according to claim 8, wherein the matrix is formed of Cu.

17. The contact material according to claim 8, wherein the Ni alloy has a film thickness in a range of 40 nm to 110 nm.

18. The contact material according to claim 8, wherein the relative density of the contact material is 93% or more of a theoretical density of the contact material.

* * * * *